United States Patent [19]

Yoshinaga et al.

[11] Patent Number: 4,995,171

[45] Date of Patent: Feb. 26, 1991

[54] GAS COMBUSTION TYPE DRYER

[75] Inventors: Sadao Yoshinaga, Ichikawa; Hiroyoshi Mashine, Souka, both of Japan

[73] Assignee: Prince Industrial Development Co., Ltd., Tokyo, Japan

[21] Appl. No.: 214,736

[22] PCT Filed: Jan. 8, 1988

[86] PCT No.: PCT/JP88/00015

§ 371 Date: May 13, 1988

§ 102(e) Date: May 13, 1988

[87] PCT Pub. No.: WO89/06095

PCT Pub. Date: Jul. 13, 1989

[51] Int. Cl.[5] ..... A45D 2/00; A45D 2/06

[52] U.S. Cl. ..... 34/97; 431/344; 431/75; 432/222

[58] Field of Search ..... 34/96, 97; 431/345, 431/344, 255, 75, 78, 354, 355, 329; 432/222

[56] References Cited

U.S. PATENT DOCUMENTS 4,555,232 11/1985 Raccah et al. ..... 34/97
4,635,382 1/1987 Bourdeau ..... 34/97
4,800,654 1/1989 Levin et al. ..... 34/97

FOREIGN PATENT DOCUMENTS 44-717 1/1969 Japan .
57-36203 2/1982 Japan .
62-41512 2/1987 Japan .

*Primary Examiner*—Henry A. Bennet
*Assistant Examiner*—Denise L. F. Gromada
*Attorney, Agent, or Firm*—Weingarten, Schurgin, Gagnebin & Hayes

[57] ABSTRACT

A gas combustion type dryer is provided wherein a liquefied gas is ignited by electric discharge and combusted to forcibly blow out heated air by a fan, while eliminating adverse effects of remaining heat after the stop of fan operation and maintaining the gas pressure constant. A temperature controller is provided together with a combustor within a blowing barrel of a dryer main body, and a pressure regulator is provided together with a liquefied gas tank within a handle. The pressure regulator is coupled to the combustor with the temperature controller interposed therebetween.

4 Claims, 3 Drawing Sheets

GAS COMBUSTION TYPE DRYER

TECHNICAL FIELD

The present invention relates to a combustion type dryer which ignites a liquefied gas as a fuel and combusts it to forcibly blow out, by a fan, heated air generated within the dryer.

BACKGROUND ART

A gas combustion type dryer of this type is constructed of a handle and a blowing barrel, the former accommodating a liquefied gas tank, a fan battery, a switch and an ignition device made of a piezoelectric unit, and the latter being of a double wall structure and having therein a combustion housing coupled to the liquefied gas tank. A jet nozzle for a liquefied gas and an ignition electrode are mounted within the combustion housing. Heated air within the combustion housing generated by combusting the liquefied gas therein is blown out of the blowing barrel by a fan mounted behind the combustion housing.

Since a dryer of this type does not require a cord as in the case of an electric dryer, it is advantageous over an electric dryer in that it can be used at any place as desired, even outdoors. However, if a fan is stopped simultaneously with stopping combustion after using the dryer, the blowing barrel is still exposed to remaining heat of the combustion housing so that it becomes necessary to continue fan cooling even after the stop of combustion, otherwise carelessly touching the blowing barrel may cause a burn. This problem can be solved to some extent if the blowing barrel is constructed of double wall structure. It is not desirable, however, in terms of handling it because of an increase of its weight.

Further, a dryer of this type utilizes combustion heat of a liquefied gas so that the gas must be supplied to the combustion area while always maintaining its pressure constant. Combustion under unstable pressure may often lead to excessive combustion or incomplete combustion, so that it becomes impossible to use it due to unstable temperature of blown air or becomes dangerous to use it.

DISCLOSURE OF INVENTION

It is an object of the present invention to provide a gas combustion type dryer which has very small remaining heat after the stop of combustion so that even if a fan is stopped simultaneously with stopping combustion, a blowing barrel is not heated by the remaining heat.

It is another object of the present invention to provide a gas combustion type dryer provided with a pressure regulator by which a liquefied gas in a liquefied gas tank can be supplied to a combustor while controlling the gas pressure always constant.

It is a further object of the present invention to provide a gas combustion type dryer with the combustor and a temperature controller mounted within the blowing barrel, wherein a gaseous liquefied gas and an air are mixed within the combustor and the mixed gas is ignited by piezoelectrically generated spark to combust it within the combustor, and wherein the temperature controller controls the combustion temperature within the combustor at a predetermined temperature or less.

According to a gas combustion type dryer achieving the above objects of the present invention, the dryer is constructed of a dryer main body and a handle mounted below the main body, the main body having a blowing barrel and a suction barrel integrally and laterally formed with respect to the former. The combustor and the temperature controller are housed within the blowing barrel, while a fan, a fan motor and a re-chargeable battery are housed within the suction barrel.

A piezoelectric unit for ignition of the liquefied gas and a liquefied gas tank coupled to a pressure regulator are housed within the handle. The pressure regulator and the combustor are coupled to each other by a flexible tube via the temperature controller.

The combustor is constructed of a laterally extending hollow tube with a jet nozzle at the back thereof and a combustion nozzle at the front thereof, a tubular heater net mounted on the hollow tube at its front outer periphery, and a block cover closing the front end of the heater net. A discharge electrode of the piezoelectric unit is mounted extending to the side of the combustion nozzle.

The temperature controller is constructed of a bimetal and a valve. Upon deformation of the bimetal by excessive heat, the valve is actuated to control the supply amount of a liquefied gas to thereby enable to lower the combustion temperature.

The fan and the fan motor of the type generally used in a dryer cause to send air, which has been guided into the back of the combustor in the dryer main body, to the blowing barrel. Thus, air heated at the heater net is blown out from the front end of the dryer main body.

The pressure regulator has a spring-biased diaphragm within a pressure regulator chamber. A gas valve is coupled at the side of the pressure regulator chamber. A lever is provided between the gas valve and an actuator mounted on the handle at its inner and upper side wall, so that the gas valve may be closed or opened by means of the actuator which also activates the piezoelectric unit and the fan.

BRIEF DESCRIPTION OF DRAWINGS

The figures show an embodiment of a gas combustion type dryer according to the present invention.

BEST MODE FOR CARRYING OUT THE INVENTION

Figure 1:
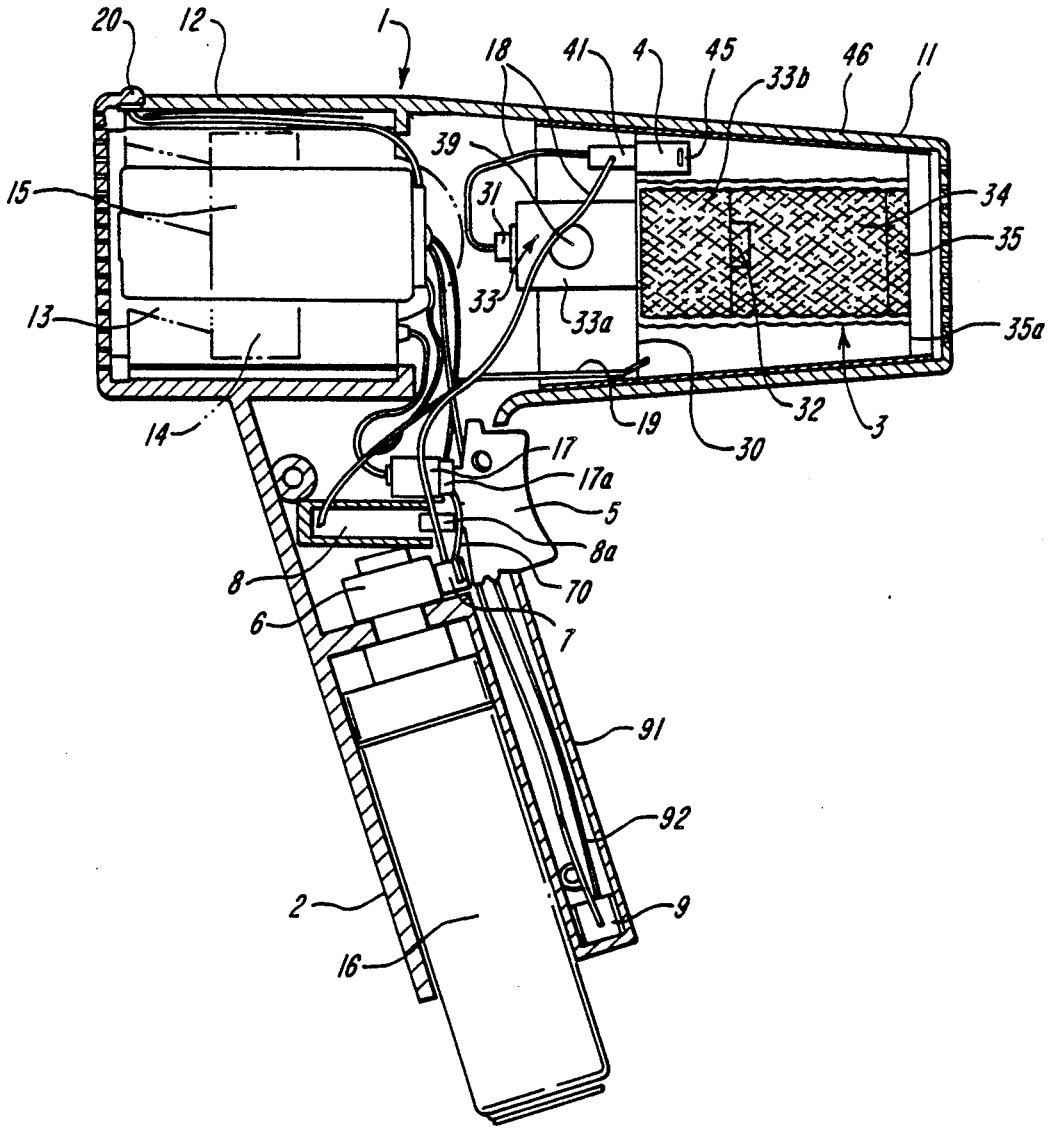
FIG. 1 is a side elevational view of the dryer main body and the handle.

Referring to FIG. 1, reference number 1 denotes a dryer main body, and reference number 2 denotes a handle mounted below the main body.

The dryer main body 1 has a blowing barrel 11 at the front thereof and a suction barrel 12 at the back thereof. A combustor 3 and a temperature controller 4 are housed within the blowing barrel 11. Housed within the suction barrel 12 are a fan 13, a fan motor 14 and a re-chargeable battery 15 for the fan motor 14.

A charging jack 9 and a cord 92 are housed within a cover 91 mounted at the inner side wall of the handle 2. An actuator 5 is pivotally mounted on the handle at its inner and upper side wall. Housed within the handle 2 are a pressure regulator 6 with a gas valve 7, and a liquefied gas tank 16 whose top is screwed with the pressure regulator 6. An piezoelectric unit 8 and a switch 17 of the fan 13 are mounted side by side within the handle near the actuator 5. The operation portions 8a and 17a of the piezoelectric unit and the switch, as well as the tip of a lever 70 for opening and closing the liquefied gas tank 7, are positioned within the handle near the actuator 5.

The combustor 3 is coupled to the gas valve 7 of the pressure regulator 6 by a flexible tube 18 made of synthetic resin via the temperature controller 4. The ground side of the piezoelectric unit 8 is electrically connected to a supporting plate 30 of the combustor 3 by means of a cord 19. Reference number 20 denotes a charging lamp.

Figure 2:
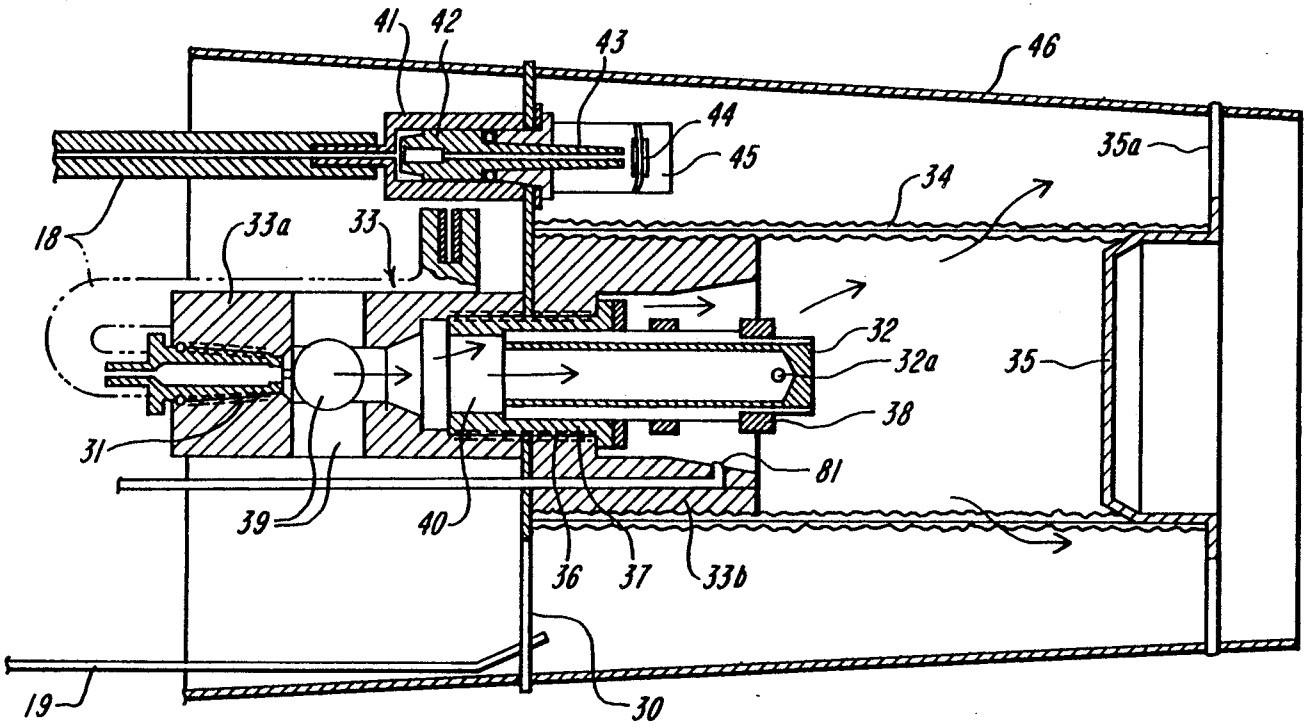
FIG. 2 is a side elevational view of the combustor.

FIG. 2 shows the structure of the combustor which is constructed of a laterally extending hollow tube 33 with a jet nozzle 31 at the back thereof and a combustion nozzle 32 at the front thereof, a tubular heater net 34 of double wall structure mounted on the hollow tube 33 at its front outer periphery, and a block cover 35 closing the front end of the heater net.

The hollow tube 33 is constructed of a back member 33a made of metal and a front member 33b made of insulating material such as ceramics. The front and back members are integrally coupled with a hollow bolt 36, with the supporting plate 30 interposed at the junction point therebetween. The combustion nozzle 32 is inserted into and pressure fit with the hollow bolt 36.

The combustion nozzle 32 is constructed of a tube whose front end is closed and whose outer periphery is provided with a spline. A nozzle 32a is formed at the front end side portion of the tube. Two metal rings 38 are mounted on the outer periphery of the tube along its longitudinal direction to make a turbulence gas flow which passes through a sub-passage 37 formed by the recess portion of the spline, the metal ring also serving as the discharge electrode.

The jet nozzle 31 is inserted into and fixed at the middle of the back portion of the back member 33a, an air inlet 39 being formed near the orifice of the jet nozzle 31. A gaseous liquefied gas jetted out of the orifice into the interior of the back member 33a is introduced together with an air into a passage 40 at the middle of the front portion of the back member 32a to produce an air-mixed gas. Most of the mixed gas is sideways guided from the nozzle 32a toward the heater net 34, but a part of the mixed gas is guided toward the heater net 34, passing through the outer side of the combustion nozzle 32 via the sub-passage 37.

A discharge electrode 81 connected to the piezoelectric unit 8 extends from the inside of the front member 33b toward the side of the combustion nozzle 32 at the front end of the sub-passage 37. Therefore, when a discharge spark is generated between the discharge electrode 81 and the metal ring 38, a primary ignition by the discharge energy occurs which in turn causes the liquefied gas flowing out of the nozzle 32a to be ignited and combusted within the heater net 34. The heater net is heated red and the air introduced by the fan is heated and blown out.

The temperature controller 4 is constructed of a valve 41 fixedly mounted on the supporting plate 30 and a bimetal plate 44. The bimetal plate 44 is arranged to be deformable in the axial direction of a valve lever 43 which is biased by a spring 42 in the outward direction thereof. The bimetal plate 44 is positioned near the tip of the valve lever with a predetermined space therebetween.

When the internal temperature of the blowing barrel 11 rises above a preset temperature, the bimetal 44 fixed at a holder 45 deforms in the inward direction and pushes the valve lever 43 against the force of the spring 42, to thereby suppress the flow rate of the liquefied gas to be supplied to the combustor 3 via the valve 41. When the temperature lowers due to the suppression of combustion, the bimetal 44 restores the original shape as the pressure by the valve lever 43 weakens, to thereby increase the flow rate. When the temperature rises abnormally, the deformation of the bimetal is also considerable so that the valve 41 is completely closed and the liquefied gas is not supplied to ultimately stop the combustion. Unless the actuator 5 is again operated to effect ignition, combustion cannot start.

In order to house the combustor 3 and the temperature controller 4 within the blowing barrel, they are fixed at a tube 46 made of thin metal plate having substantially the same dimension as the inner diameter of the blowing barrel 11. The tube 46 is formed with holes for receiving protrusions formed on both the supporting plate 30 and a supporting plate 35a integral with the glow cover 35. By engaging the holes with the protrusions while deforming the tube 46 in the diammetrical direction, the combustor, temperature controller and blowing barrel can be fixed to each other by the tube 46.

Figure 3:
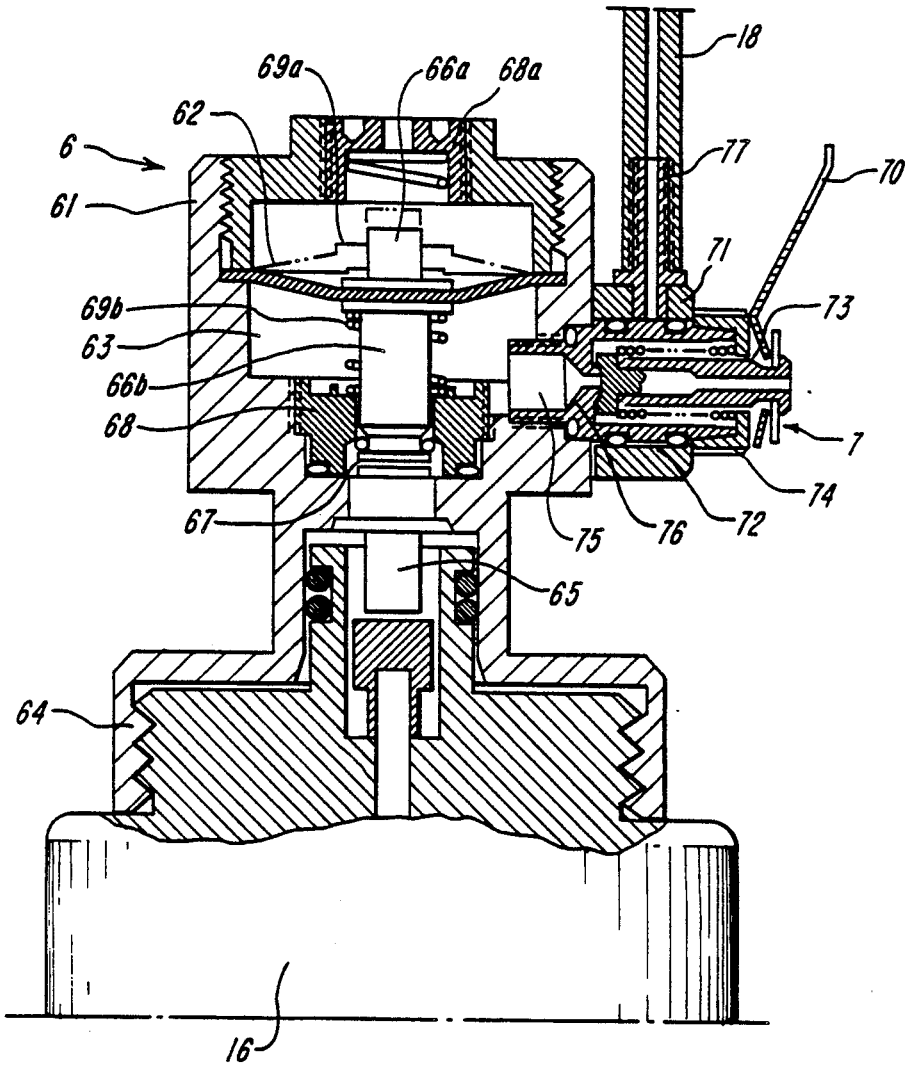
FIG. 3 is a side elevational view of the pressure regulator with a liquefied gas tank being coupled.

FIG. 3 shows the structure of the pressure regulator 6 which has a pressure regulator chamber 63 within it main body 61, the chamber being partitioned by a diaphragm 62. The gas valve 7 is coupled to the pressure regulator chamber 63 at its upper side portion. The bottom end portion of the main body 61 is integrally formed with a receptacle 64 to be screwed with the top end portion of the liquefied gas tank 16, a pushing member 65 for releasing a valve of the gas tank 16 being protruded at the center of the receptacle 64.

The peripheral edge portion of the diaphragm 62 is fixed at the main body 61, while the central portion thereof is squeezed by the flanges of shafts 66a and 66b. One end portion of the shaft 66b extends into a valve seat sleeve 68 screwed with a valve chamber 67 adjacent to the pressure regulator chamber 63, and has at its end a gas-sealing O ring for contacting the bottom end of the sleeve. Both the shafts 66a and 66b are provided with balancing coil springs 69a and 69b resiliently pushing the shafts, the forces of the springs being adjusted as desired by rotating a member 68a.

The gas valve 7 has a tubular main body 71 within which a valve rod 73 formed with a valve body 72 at its one end is movably mounted. The other end of the valve body 72 is coupled to the above-mentioned lever 70 and always resiliently biased by a coil spring 74 in the direction of closing the gas valve, to thereby prevent the gas in the pressure regulator chamber 63 from being driven out via a filter 75 and a valve seat 76. The flexible tube 18 is coupled to a flow outlet tube 77 positioned at the side of the main body 61, to thereby interconnect the pressure regulator 6 and the jet nozzle 31 of the combustor 3.

In operation of the gas combustion type dryer constructed as above, the handle 2 is gripped to push the actuator 5 inward like a gun trigger. The lever 7 is pushed accordingly to move the valve rod 73 of the gas valve 7 outward against the force of the coil spring 74 and open the valve. Thus, a liquefied gas in the gas tank 16 flows into the valve chamber 67 and further to the pressure regulator chamber 63 via a clearance between the sleeve 68 and the O ring. After the flow pressure of the liquefied gas has been controlled in the pressure regulator chamber 63 by the diaphragm 62 and the coil springs, it passes through the gas valve via the filter 75.

The liquefied gas is further directed via the tube 18 to the temperature controller 4 and the jet nozzle 31 of the combustor 3. The liquefied gas jetted out of the jet nozzle into the hollow body 33 is then delivered into the heater net 34 from the inside and outside of the combustion nozzle 32 as previously described.

The piezoelectric unit 8 is actuated slightly after the gas valve 7 has been opened so that piezoelectricity generated by an impact upon the piezoelectric element discharges across the path near the combustion nozzle to thereby effect ignition and combustion of the liquefied gas as discussed previously. Simultaneously with the actuation of the piezoelectric unit, the switch 17 is turned on to rotate the fan 13 and start blowing out combustion heat. This blow continues until the actuator 5 is released.

Upon release of the actuator 5, the switch 17 is turned off to stop rotating the fan 13 and restore the original position of the lever 70, thus closing the gas valve 7. The operation portion 8*a* of the piezoelectric unit 8 similarly restores its original position to thereby enable to again effect an impact on the piezoelectric element.

In the above condition, there is no remaining heat since combustion is effected in the interior of the heat net, and the blowing barrel 11 is not heated by remaining heat even after the fan 13 is stopped.

INDUSTRIAL APPLICABILITY

As described so far, the gas combustion type dryer of this invention is so constructed that a liquefied gas is combusted within the heater net and its combustion heat is blown out together with air by the fan, and that the liquefied gas supplied to the combustor is controlled by the pressure regulator to thereby make unstable gas pressure always constant and aim at stable combustion. Therefore, although the dryer is of the type generating heated air through gas combustion, it has good stability and can be used conveniently anywhere as desired. Thus, it has considerable advantageous effects and can effectively be used in various fields of industries.

We claim:

1. A gas combustion type dryer comprising:

a dryer main body having a blowing barrel at the front thereof and a suction barrel at the back thereof, the former having a combustor therein and the latter having a fan, a fan motor and a battery therein;

a handle mounted below said dryer main body, said handle having therein a liquefied gas tank and a piezoelectric unit for electric discharge ignition and having an actuator mounted at the inner and upper wall of said handle;

a temperature controller mounted within said blowing barrel in cooperative association with said combustor; and a pressure regulator mounted within said handle and coupled to said liquefied gas tank;

wherein said pressure regulator is coupled to said combustor via said temperature controller via a tube, and said combustor comprises:

a hollow tube main body having a jet nozzle at the back portion thereof and a combustion nozzle at the front portion thereof;

a tubular heater net mounted on said hollow tube main body at its front outer periphery; and a block cover closing the front end of said heater net.

2. A gas combustion type dryer according to claim 1, wherein said hollow tube main body of said combustor is constructed of a back member made of metal and a front member made of insulating material, said front and back members being integrally coupled with a hollow bolt, with a supporting plate interposed at the junction point therebetween, and wherein said jet nozzle is inserted into and fixed at the middle of the back portion of said back member, with an air inlet being formed at said back member near said jet nozzle, and said combustion nozzle is inserted into and pressure fit with said hollow bolt in said front member, with a nozzle being formed at the side of a closed front end of said combustion nozzle and a spline being formed at the outer periphery of said combustion nozzle.

3. A gas combustion type dryer according to claim 1, wherein said pressure regulator has a pressure regulator chamber partitioned with a diaphragm and a gas valve mounted at the side of said pressure regulator chamber and having a lever for opening and closing said gas valve, the peripheral edge portion of said diaphragm is fixed at the main body of said pressure regulator while the central portion thereof is squeezed by shafts biased by coil springs respectively, one of said shafts extends into a valve seat sleeve defining a valve chamber, and a liquefied gas passes through a clearance between said sleeve and an O ring mounted on the tip of said one shaft.

4. A gas combustion type dryer according to claim 1, wherein said temperature controller is constructed of a valve fixedly mounted on a supporting plate on said combustor and a bimetal plate, said bimetal plate being arranged to be deformable in the axial direction of a valve lever which is biased by a spring in the outward direction thereof, and said bimetal plate being positioned near the tip of said valve lever with a predetermined space therebetween.

* * * * *